US006733298B2

(12) United States Patent
Chen

(10) Patent No.: US 6,733,298 B2
(45) **Date of Patent: *May 11, 2004**

(54) REVERSIBLE COLORFUL WRITING APPARATUS

(76) Inventor: Shih-Chi Chen, 7th Floor, No. 34, Hung-Chang 12th Street, Taoyuan City, Taiwan (TW)

( * ) Notice: Subject to any disclaimer, the term of this patent is extended or adjusted under 35 U.S.C. 154(b) by 109 days.

This patent is subject to a terminal disclaimer.

(21) Appl. No.: 10/356,243

(22) Filed: Jan. 30, 2003

(65) Prior Publication Data

US 2003/0148255 A1 Aug. 7, 2003

(30) Foreign Application Priority Data

Feb. 6, 2002 (TW) ..... 91201425 0 U

(51) Int. Cl.[7] ..... B43L 1/00
(52) U.S. Cl. ..... 434/409
(58) Field of Search ..... 434/408, 409; 428/321.5, 320.2, 338, 900

(56) References Cited

U.S. PATENT DOCUMENTS 3,633,720 A * 1/1972 Tyler ..... 400/105
4,143,472 A * 3/1979 Murata et al. ..... 434/409
4,232,084 A * 11/1980 Tate ..... 428/321.5
4,931,019 A * 6/1990 Park ..... 434/409
RE33,363 E * 10/1990 Miller ..... 434/409
5,295,837 A * 3/1994 Gilano et al. ..... 434/409
5,820,385 A * 10/1998 Ohashi et al. ..... 434/409
6,103,347 A * 8/2000 Nojima et al. ..... 428/174
6,183,262 B1 * 2/2001 Tseng ..... 434/409
6,196,848 B1 * 3/2001 Yamazaki ..... 434/409
6,315,573 B1 * 11/2001 Hirota et al. ..... 434/409

* cited by examiner

*Primary Examiner*—Kurt Fernstrom

(57) ABSTRACT

A reversible colorful writing apparatus includes a reversible writing board composed of a plurality of coloring picture tubes each filled with a plurality of immiscible coloring liquids in each coloring picture tube and suspended with a miniature magnet within each picture tube, and an inkless writing pen having a stepping-motor control circuit provided within the writing pen; whereby upon moving of the pen on the board, the stepping-motor control circuit will drive the miniature magnet forwardly (or reversely) in each picture tube to drive the immiscible coloring liquids forwardly (or reversely); and upon setting of the magnet at a specific position in the tube, a specific coloring liquid corresponding to such a specific magnet position will be driven to the top surface of the picture tube to display such a specific color on the board.

10 Claims, 3 Drawing Sheets

101
100
1
m
n
102

1
12
13
14
11
15

REVERSIBLE COLORFUL WRITING APPARATUS

BACKGROUND OF THE INVENTION

A conventional blackboard may be written with a chalk on the board. However, the dust as spread from the blackboard may cause air pollution for a teacher and the students in a classroom. A so-called "white board" may use a marker pen filled with marking ink therein for substituting the conventional chalk for writing on the whiteboard. However, the solvent of the ink within the marker pen will be easily vaporized, still contaminating the air. Once the ink is exhausted or dried, a new pen should be provided to thereby waste money.

The present inventor has found the drawbacks of the conventional writing boards and invented the present reversible colorful writing board and pen.

SUMMARY OF THE INVENTION

The object of the present invention is to provide a reversible colorful writing apparatus including a reversible writing board composed of a plurality of coloring picture tubes each filled with a plurality of immiscible coloring liquids in each coloring picture tube and suspended with a miniature magnet within each picture tube, and an inkless writing pen having a stepping-motor control circuit provided within the writing pen; whereby upon moving of the pen on the board, the stepping-motor control circuit will drive the miniature magnet forwardly (or reversely) in each picture tube to drive the immiscible coloring liquids forwardly (or reversely); and upon setting of the magnet at a specific position in the tube, a specific coloring liquid corresponding to such a specific magnet position will be driven to the top surface of the picture tube to display such a specific color on the board.

DETAILED DESCRIPTION

Figures 1, 2:
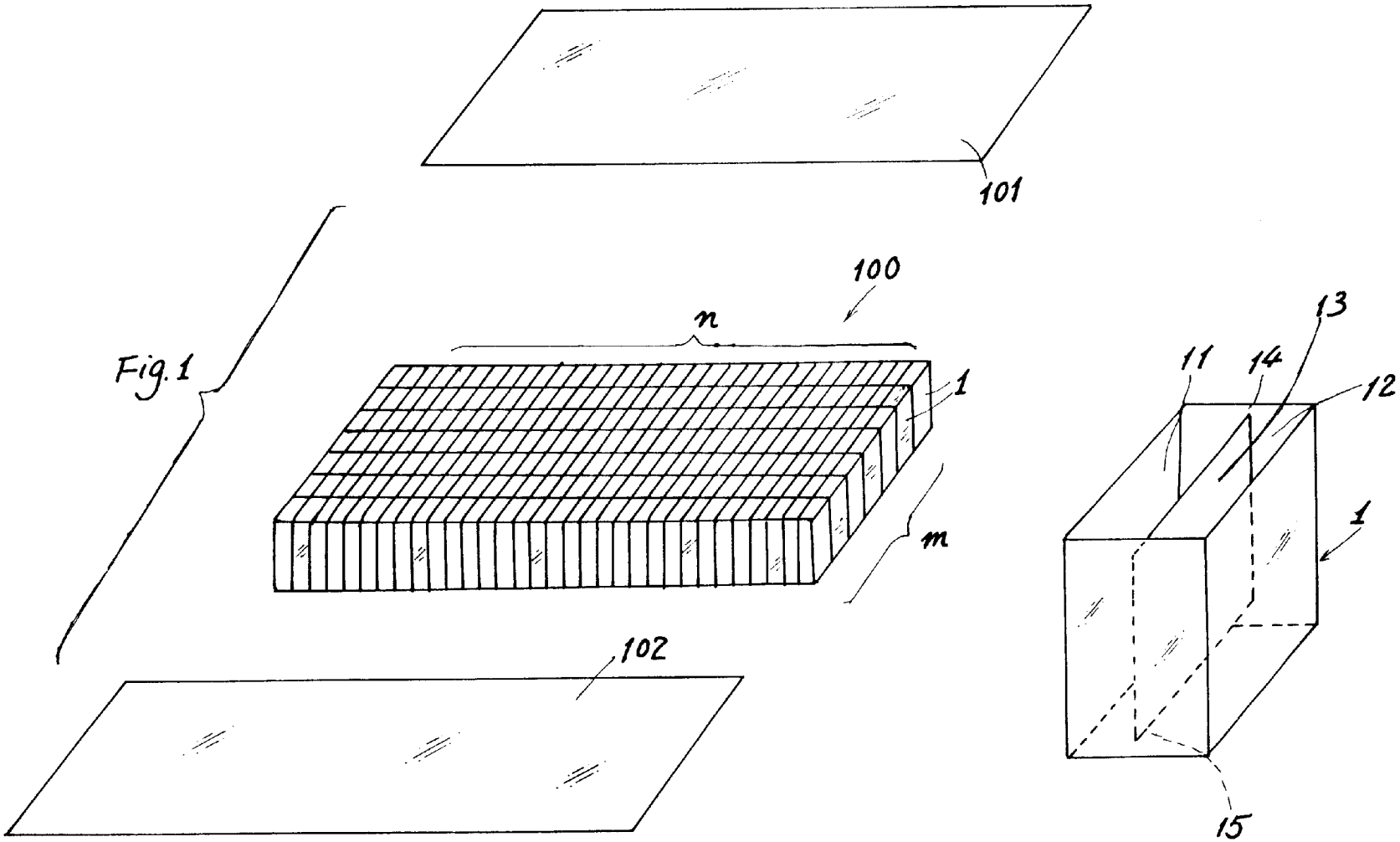
FIG. 1 is an illustration showing the writing board of the present invention.
FIG. 2 is a perspective view of each coloring picture tube of the writing board.
Figure 3:
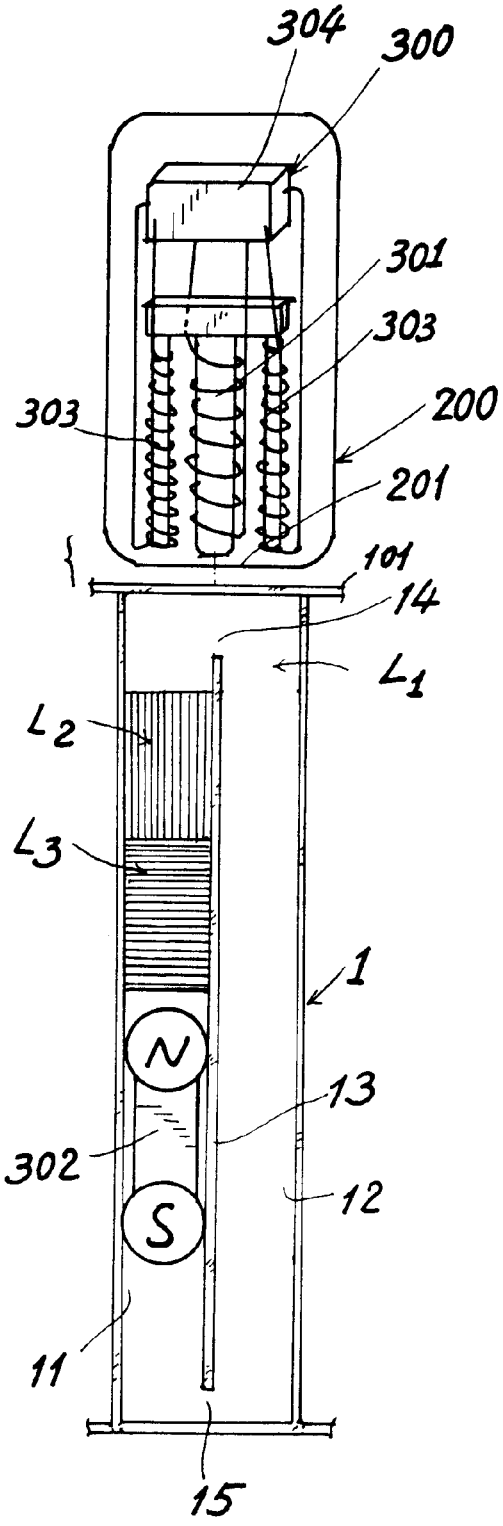
FIG. 3 is a sectional drawing of each picture tube and the writing pen of the present invention.

As shown in the drawing figures, the present invention comprises: a reversible writing board 100 composed of a plurality of coloring picture tubes 1 each having a plurality of immiscible coloring liquids (L1, L2, L3 . . . ) superimposedly filled within each picture tube 1; an inkless writing pen 200; and a stepping-motor control circuit 300 provided in the writing pen 200 and in each picture tube 1 for driving the liquids in each picture tube for selectively displaying the color of a specific liquid on the top surface of the picture tube 1.

Each coloring picture tube 1 includes: a shuttle chamber 11 having the miniature magnet 302 slidably held therein, a buffer chamber 12 juxtapositioned to the shuttle chamber 11 having a central partition plate 13 separating the shuttle chamber 11 and the buffer chamber 12, an upper port 14 notched in an upper portion of the central partition plate 13, a lower port 15 notched in a lower portion of the central partition plate 13, a bottom cover and a top cover encasing a bottom and a top of the picture tube 1.

The top cover and the bottom cover can be integrally formed respectively such as the numeral 101 indicating the top cover and the numeral 102 indicating the bottom cover.

The top cover 101 must be formed with transparent material and formed as magnetically conductive and electrically conductive.

The casing of the picture tube 1 is preferably made of transparent material for clearly showing the colorful liquids as filled in the tubes 1. The geometric shape of the tube 1 is preferably made as parallelepiped or cubic.

The inkless writing pen 200 has the major parts of the stepping-motor control circuit 300 provided therein, having a writing head 201 movably contacting a top surface of each picture tube 1 for writing words or drawing figures on the writing board 100 composed of the plurality of picture tubes 1.

The stepping-motor control circuit 300 includes: a driver 301, a miniature magnet 302, a sensor 303 and a controller 304.

Figure 4:
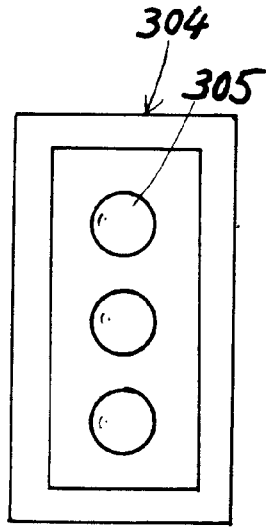
FIG. 4 shows a control panel of the present invention.

The driver 301, the sensor 303 and the controller 304 are formed or secured in the writing pen; having a plurality of push buttons or selectors 305 formed on a control panel (FIG. 4) formed on the writing pen 200 for selectively controlling the positioning of the miniature magnet 302 slidably shuttling in the picture tube 1.

As shown in FIGS. 3~8, each picture tube 1 is filled with a plurality of immiscible coloring liquids (L1, L2, L3 . . . etc.) in the chambers 11, 12 of the tube 1, with the coloring liquids being immiscible with one another and generally having the same specific gravity.

The miniature magnet 302 has two poles N, S on opposite ends of the magnet 302, with the opposite ends formed as arcuate or spherical shape for smoothly shuttling in the tube chamber 11. The magnet 302 has a specific gravity generally equal to that of each coloring liquid.

The surface tension of each coloring liquid may balance the weight of the magnet 302 without gravitational descending when suspending in the coloring liquid.

The magnet 302 has a cross sectional area generally equal to an inside cross sectional area of the shuttle chamber 101 in the picture tube 1 to play like a "piston" for pumping (driving) the liquid in the chamber 11 either upwardly or downwardly.

The miniature magnet 302 is first inserted into the lower position in the shuttle chamber 11 (FIGS. 3, 6) to be separated from the writing head 201 of the pen 200 with a first distance D1 and the top surface now presents the first coloring liquid L1, e.g., a white-color liquid.

Figure 7:
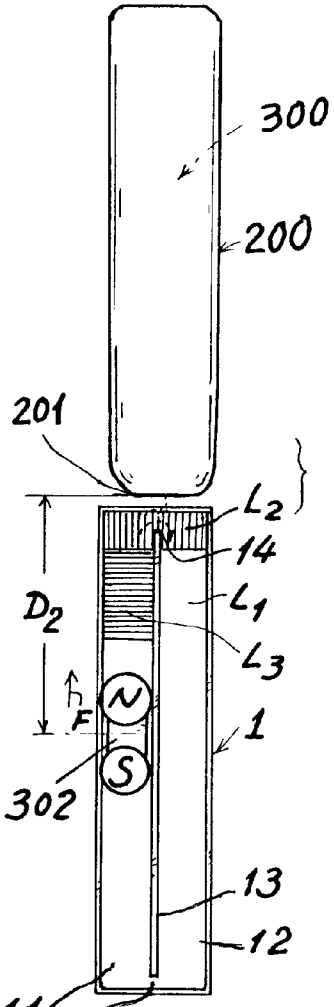
FIG. 7 shows a second operational step of the present invention.
Figure 6:
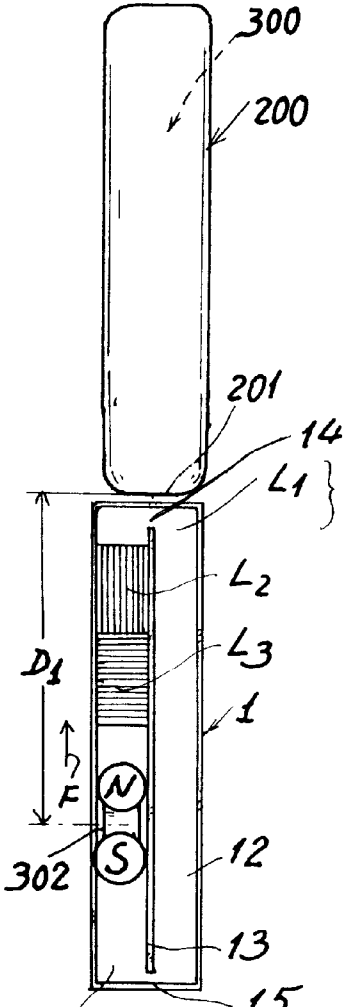
FIG. 6 shows a first operational step of the present invention.

Upon selection of the push buttons 305 on the controller 304 such as a second color L2 of red color as shown in FIG. 7, a pulse signal from the controller 304 will be sent to the driver 301 to energize or magnetize the driver 301 to magnetically attract the magnet 302 in the chamber 11 of the tube 1 from the first position of FIG. 6 to the second position of FIG. 7 to be separated from the writing head 201 with a second distance D2, whereby the magnet 302 will act like a piston to drive the liquid clockwise in a forward direction F through the two chambers 11, 12 to "upgrade" the second liquid L2 (red color) to the top surface of the tube 1 to change the white color (L1) to be red color (L2).

Figure 8:
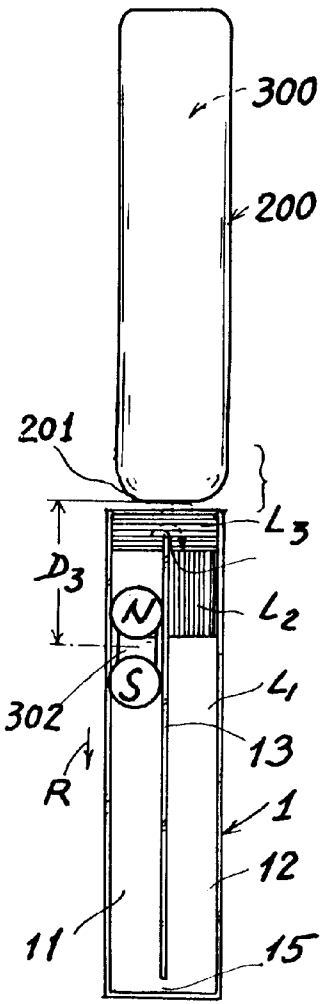
FIG. 8 shows a third operational step of the present invention.

Subsequently, the controller 304 may be operated to forwardly shift the third color L3, e.g., blue color to the top surface as shown in FIG. 8 to have a third distance D3 between the magnet and pen. Therefore, a plurality of colors (L1, L2, L3 . . . ) can be optionally chosen for varying the writing colors for enriching the user's interest.

The circuit 300 may be powered by a dry cell or battery (not shown) stored in the pen 200.

If the magnet 302 is reversely driven (direction R), the magnet 302 may be restored downwardly such as from FIG. 8 to FIG. 6 to its original position.

Figure 5:
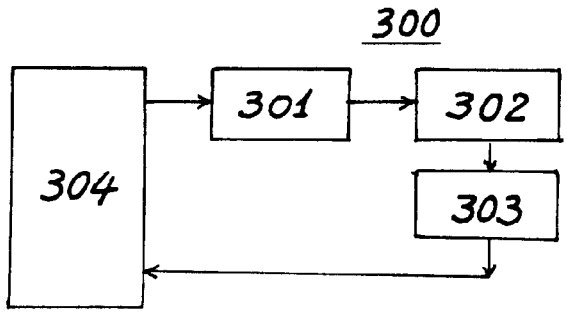
FIG. 5 shows a circuit diagram of the stepping-motor circuit of the present invention.

As shown in FIG. 5, during the magnetic attraction or repulsion for moving the magnet 302 by the driver 301 which is energized by the pulse signal (including forward and reverse pulse signals) as sent from the controller 304, a sensor 303 will detect the position of the magnet and will send a feedback signal to the controller 304 for comparison with the predetermined data (such as position, magnetic flux, voltage or other signals). If the magnet 302 is not held at the right position, the controller 304 will issue a pulse signal to the driver 302 for further adjusting the position of the magnet until reaching the right position precisely.

Each liquid (L1, L2, L3 . . . ) should have a viscosity having a frictional force with the inside wall of the tube 1 to be greater than the weight (gravitational force) of the magnet 302 so that the magnet 302 will be kept or suspended at the specific position in the liquid when the magnetic force disappears when the controller is not operated.

The controller 304 may be formed as a chip having all the necessary control elements formed as an integrated circuit (IC) to be assembled into such an IC.

The driver 301 may be formed as a plurality of electromagnetic coils for generating stepping magnetic field like a stepping motor for moving the magnet 302 stepwise either forwardly (F) or reversely (R). The sensor 303 may be an induction coil for sensing the signals of change of induction voltage upon the variation of the position of the magnet 302. The signal as sensed by the sensor 303 will be sent, as a feedback signal, to the controller 304 for precisely controlling the magnet 302.

The liquids are all encased within the tubes 1, not vaporizable. Therefore, no vaporization loss of the liquid and no air pollution will occur.

The writing board 100 can be "erased" by a erasing pad which is substantially formed in situ by the writing pen 200 if the color of the liquid is set as white color, whereby upon moving of the "white-color" pen 200 on the board 100, the white color (L1) will be presented (recovered) on the top surface of the tubes 1 for "resetting" the writing board 100 ready for next writing or drawing purpose.

When driven by the magnet 302, the liquids (L1, L2, L3 . . . ) will be clockwise (F) recycled from the shuttle chamber 11, the upper port 14, the buffer chamber 12, and the lower port 15. Or, the liquids may be recycled in a counterclockwise direction (R) opposite to the clockwise direction (F) as abovementioned.

The present invention may be modified without departing from the spirit and scope of the present invention.

I claim:

1. A reversible colorful writing apparatus comprising: a reversible writing board composed of a plurality of coloring picture tubes each said coloring picture tube having a plurality of immiscible coloring liquids filled in each said coloring picture tube and having a miniature magnet suspended within each said picture tube; and an inkless writing pen having a stepping-motor control circuit formed within the writing pen, said stepping-motor control circuit operatively driving said miniature magnet in each said picture tube when said writing pen movably contacting said picture tube; whereby upon moving of the pen to one said picture tube on the board, the stepping-motor control circuit will drive the miniature magnet forwardly or reversely in said picture tube to drive the immiscible coloring liquids forwardly or reversely; and upon setting of the magnet at a specific position in the tube, a specific coloring liquid corresponding to the specific position of the magnet in the tube will be driven to the top surface of the picture tube to display the color of said specific coloring liquid on the writing board.

2. A reversible colorful writing apparatus according to claim 1, wherein each said coloring picture tube includes: a shuttle chamber having the miniature magnet slidably held therein for driving the coloring liquids, a buffer chamber juxtapositioned to the shuttle chamber having a central partition plate separating the shuttle chamber and the buffer chamber, an upper port notched in an upper portion of the central partition plate, a lower port notched in a lower portion of the central partition plate, a bottom cover and a top cover respectively covering a bottom and a top of the picture tube.

3. A reversible colorful writing apparatus according to claim 2, wherein said top cover is formed with transparent material and is magnetically conductive and electrically conductive.

4. A reversible colorful writing apparatus according to claim 1, wherein said stepping-motor control circuit includes: a driver operatively magnetically actuating the miniature magnet in said picture tube, a sensor for sensing the position of said magnet in the tube, and a controller for sending pulse signals for energizing the driver and for receiving feedback signals as sensed by said sensor for controlling the position of the magnet in said tube.

5. A reversible colorful writing apparatus according to claim 4, wherein the driver, the sensor and the controller are secured in the writing pen; said writing pen including a plurality of push buttons formed on a control panel formed on the writing pen for selectively controlling the positioning of the miniature magnet slidably shuttling in the picture tube.

6. A reversible colorful writing apparatus according to claim 1, wherein each said picture tube is filled with said plurality of immiscible coloring liquids in the tube, with the coloring liquids being immiscible with one another and having the same specific gravity.

7. A reversible colorful writing apparatus according to claim 1, wherein said miniature magnet has two poles formed on opposite ends of the magnet, with the opposite ends formed as arcuate shape for smoothly shuttling in the tube, said magnet having a specific gravity equal to that of each said coloring liquid.

8. A reversible colorful writing apparatus according to claim 7, wherein said magnet has a cross sectional area equal to an inside cross sectional area of a shuttle chamber formed in the picture tube for driving the liquid in the shuttle chamber upwardly or downwardly.

9. A reversible colorful writing apparatus according to claim 1, wherein each said coloring liquid has a viscosity having a frictional force with the inside wall of the picture tube and the frictional force is greater than the weight of the magnet so that the magnet will stop at a position in the tube when the magnetic force is de-energized when the control circuit is not operated.

10. A reversible colorful writing apparatus according to claim 1, wherein said writing apparatus further includes a erasing pad which is directly formed by one said writing pen wherein the color of the liquid is set as white color, whereby upon moving of the pen on the writing board, the white color will be presented on the top surface of the tubes for resetting the writing board.

* * * * *